United States Patent [19]

Fratty

[11] 4,238,817

[45] Dec. 9, 1980

[54] AUTOMOBILE HEADLIGHT

[75] Inventor: Hector Fratty, Boulogne, France

[73] Assignee: Cibie Projecteurs, Bobigny, France

[21] Appl. No.: 917,756

[22] Filed: Jun. 21, 1978

[30] Foreign Application Priority Data

Jul. 1, 1977 [FR] France ..... 77 20338

[51] Int. Cl.[3] ..... F21V 7/00

[52] U.S. Cl. ..... 362/309; 362/61; 362/303; 362/346

[58] Field of Search ..... 362/61, 64, 80, 83, 362/303, 309, 337, 338, 339, 340, 346

[56] References Cited

U.S. PATENT DOCUMENTS

| | | | |
|---|---|---|---|
| 1,556,158 | 10/1925 | Patch | 362/337 |
| 2,558,422 | 6/1951 | DeLeo | 362/337 |
| 3,136,914 | 6/1964 | Jayne | 362/309 |
| 3,749,906 | 7/1973 | Thiry | 362/303 |
| 3,796,886 | 3/1974 | Freeman | 362/303 |
| 4,142,229 | 2/1979 | Hulbert | 362/309 |

*Primary Examiner*—Donald P. Walsh

*Attorney, Agent, or Firm*—Cullen, Sloman, Cantor, Grauer, Scott & Rutherford

[57] ABSTRACT

The present invention relates to an automobile headlight comprising a parabolic reflector, a front glass and a twin-filament lamp for far-beam and dipped-beam located on the optical axis of the reflector on either side of the focus thereof, said headlight being characterized in that a screen located in the front and in the upper part of the lamp defines on the reflector a zone which is struck only by the rays issuing from the far-beam filament. The corresponding zone of the front glass is also determined solely as a function of the far-beam filament.

3 Claims, 7 Drawing Figures

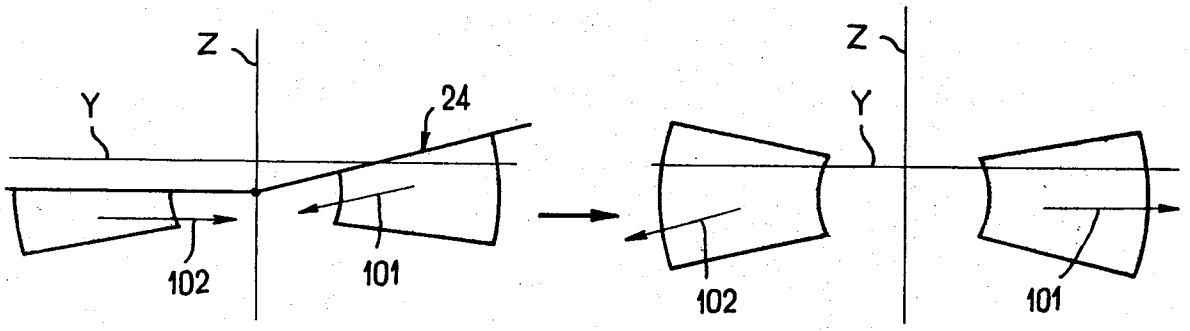
FIG. 1
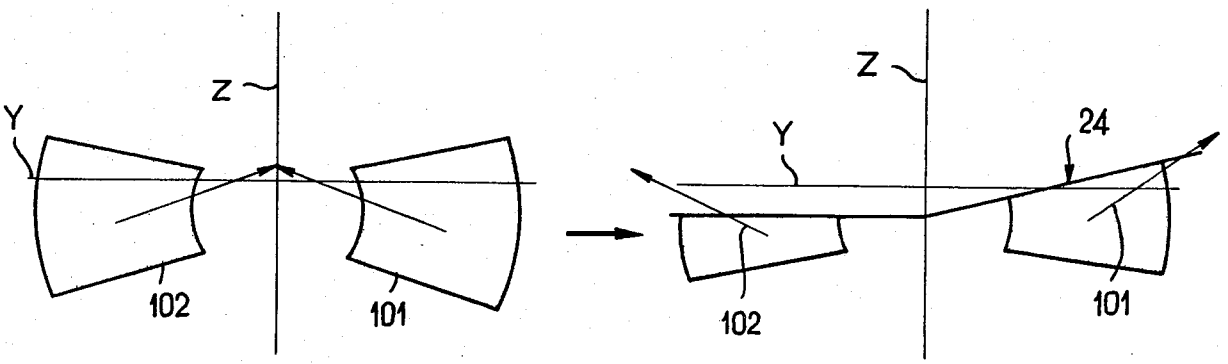
FIG. 2A
FIG. 2
FIG. 2

AUTOMOBILE HEADLIGHT

The present invention relates to automobile headlights having a large frontal opening.

The majority of present automobile headlights comprise a parabolic reflector, a front glass and a twin-filament lamp disposed so that the two filaments, far-beam and dipped-beam, are located approximately on the optical axis, on either side of the focus of the reflector, the far-beam filament being located between the apex of the reflector and the focus.

In this type of headlight, the front glass is provided, over the greater part of its surface, with a network of grooves, prisms or the like, adapted to orient and ensure a suitable diffusion both of the far-beam and the dipped-beam. The determination of these grooves results from a compromise, in view of the necessity of spreading out the dipped-beam, of average range, widely and, on the contrary, of concentrating the far-beam, of long range, in order to give it a high intensity.

In fact, to have a good concentration and good homogeneity in dipped-beam illumination, the necessary deflection of the beam provoked by the front glass corresponds to a considerable heterogeneity and poor positioning of the far-beam. Similarly, a good concentration and good orientation of the far-beam cause a heterogeneity and poor positioning of the dipped beam. It therefore appears difficult to obtain both a good dipped-beam and a good far-beam, this imcompatibility increasing with the size (opening) of the headlight. Furthermore, the technical production of wide opening headlights raises problems which are difficult to solve for the conventional reflectors made by stamping; the most deformed and least precise zone, located on the periphery of the reflector, provokes imperfections in the illumination, which are particularly marked in dipped-beam illumination.

The present invention enables these drawbacks to be solved and it finds a particularly advantageous application in the case of wide opening headlights.

The headlight according to the invention, conventionally comprising a parabolic reflector, a front glass provided with grooves and a twin-filament lamp for far-beam and dipped-beam illumination, is characterised in that it comprises intercepting means for defining on the periphery of the reflector a zone which is struck only by the rays emitted by the far-beam filament. To this zone corresponds a homologous part of the front glass through which only the rays issuing from the far-beam filament therefore pass and which comprises a network of grooves and prisms which is determined solely as a function of the far-beam. The remaining zone of the front glass is then determined virtually as a function of the dipped-beam only. It is seen that by separating to a maximum the zones through which the far- and dipped-beams are to pass, it is possible to eliminate to a large extent the problem of the abovedescribed compromise in adjustment. It is of course quite possible to give variable shapes to the intercepting means which are, however, advantageously constituted by a screen located at the front and in the upper part of the lamp. With a screen of regular shape, an intercepting zone is easily obtained, located on the periphery of the front glass and having an inner limit substantially parallel to the outer contours of the glass. The screen may also be used to prevent the direct transmission of the light from the lamp to the front glass without it being previously reflected on the reflector.

In the current case of rectangular headlights, the joining means between the reflector and the glass (sides) may be used as reflector for the far-beam only.

The invention will be more readily understood on reading the following description with reference to the accompanying drawings, in which:

FIG. 1 shows the projection of the dipped-beams issuing from the horizontal parts of a headlight on a vertical transverse screen in the case of it being desired to perfect the dipped-beam.

FIG. IA is a corresponding view of the far beams.

FIG. 2 is equivalent to FIG. 1, in the case of it being desired to perfect the far-beam.

FIG. 2A is a corresponding view of the dipped beams.

Figure 4:
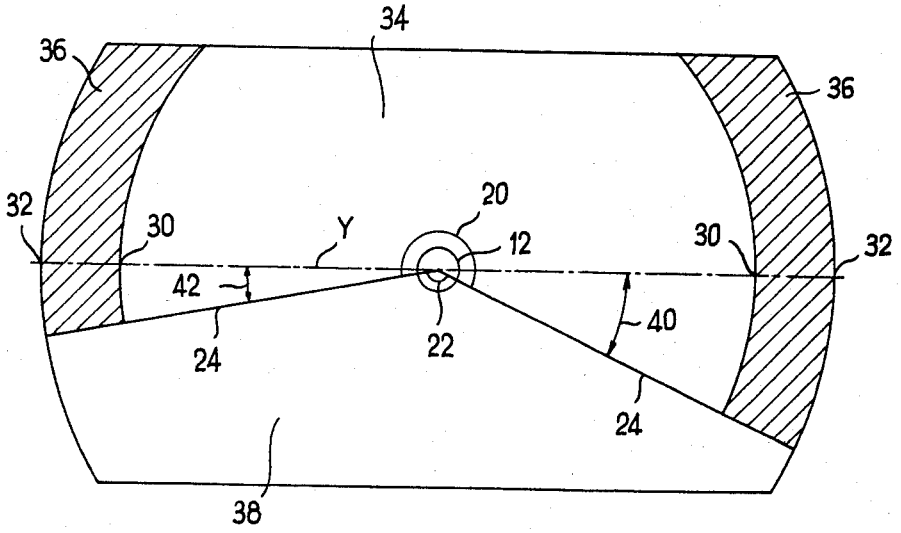
FIG. 4 shows a front view of the same sealed beam unit as the preceding Figure.

Referring now to the drawings, FIGS. 1 and 2 clearly show the difficulty of the compromise in adjustment between the far-beam and the dipped-beam. The dark zones represent the dipped- and far-beams issuing from the horizontal parts of the reflector, the non-illuminated zone corresponding to the apex of the paraboloid where the central openig intended for positioning the lamp is located. The axes referenced Z and Y represent, respectively, the vertical axis and the transverse horizontal axis of the vertical projection plane perpendicular to the optical axis of the reflector. The point of convergence of these two axes is of course located on the optical axis of the reflector.

The left-hand side of FIG. 1 shows a well adjusted dipped-beam having a good concentration and good homogeneity. 24 denotes the upper cut of the dipped-beam. Arrows 101 and 102 show, respectively, the direction of deflections of the right-hand part and the left-hand part of the beam. With this adjustment, a projection shown on the right-hand side of FIG. 1 is obtained in far-beam illumination. This considerably heterogeneous and poorly positioned beam has reverse directions of deflection which have for their effect to be prejudicial to the concentration necessary for the good adjustment of the far-beam.

The phenomenon shown in FIG. 2 is the same; it is observed that a good adjustment of the far-beam on the left-hand side of the Figure causes a poor adjustment of the dipped-beam shown on the right-hand side of the Figure. It will be noted in particular that a good concentration (arrows 101, 102) of the far-beam causes a diffusion and rise of the dipped-beam above the cut-off limit 24, which renders this beam dazzling.

Figure 3:
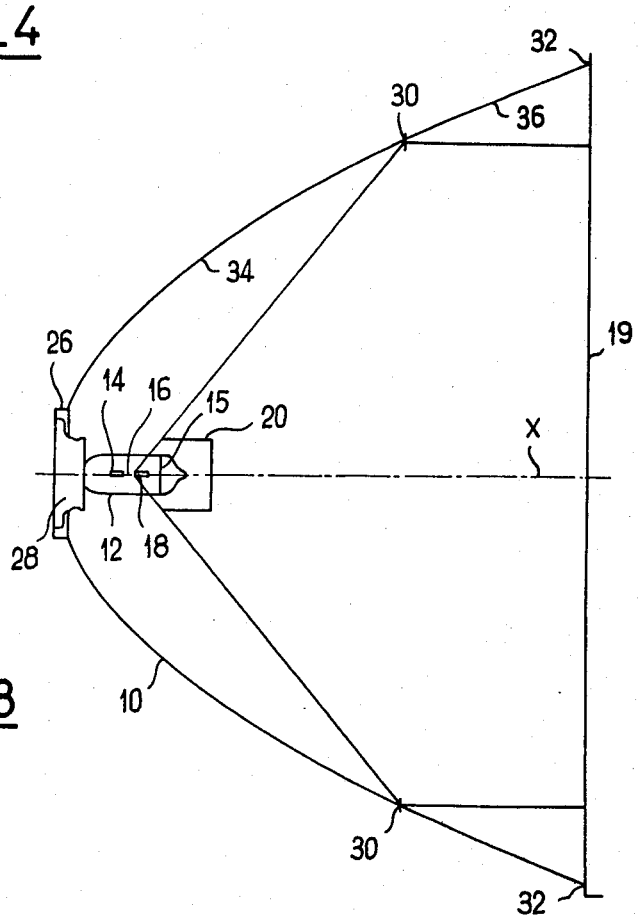
FIG. 3 shows a section through a sealed beam unit according to the invention along a horizontal plane passing through the axis of the reflector.

FIGS. 3 and 4 clearly show the functioning of the device of the invention. Axis X is the optical axis of the reflector 10 provided with an opening 26 in which is fitted a lamp support 28 which maintains a lamp 12 on the axis X. The far-beam and dipped-beam filaments 14 and 18 respectively are located on either side of the focus 16 whilst a direct light screen 15 prevents the light rays from directly passing through the front glass 19 without their previously being reflected on the reflector. The screen 20 located in the front part of the lamp 12 prevents the light rays issuing from the dipped-beam filament 18 from striking the zone 36 located between the limiting point 30 for dipped-beam and the outer limiting point of the reflector 32. On the contrary, the zone 34, located between the opening 26 and the point 30, is subjected entirely to the rays issuing from both the far-beam filament 14 and the dipped-beam filament 18. It should be noted that the screen 20 may advantageously act as direct light screen 15.

FIG. 4 shows a front view of the same sealed beam unit as before, showing the peripheral zone 36 due to the screen 20 and which is subjected only to the rays issuing from the far-beam element. The screen 22, located below the dipped-beam filament in the lamp 12 serves to define the cut 24 of the dipped-beam which strikes the zone 34. The angles 40 and 42 of the cut 24 with the transverse horizontal axis Y are of unequal value so as to illuminate differently the verge of the highway and the lane used by oncoming traffic which must not be dazzled. A value of 25° is preferably chosen for angle 40 and 10° for angle 42. The zone 38, due to the screen, is subjected only to the rays issuing from the far-beam filament. In summary, when the dipped-beam filament is used for illuminating the highway, the rays which it emits are reflected by zone 34. On the other hand, when the far-beam filament is used, its rays are reflected by all the zones 34, 36 and 38. It is therefore understood that the invention provides an adjustment of that part of the front glass corresponding to the zone 34 which is virtually solely determined as a function of the dipped-beam only, whilst zones 38 and 36 on the front glass are determined as a function of the far-beam only.

Figure 5:
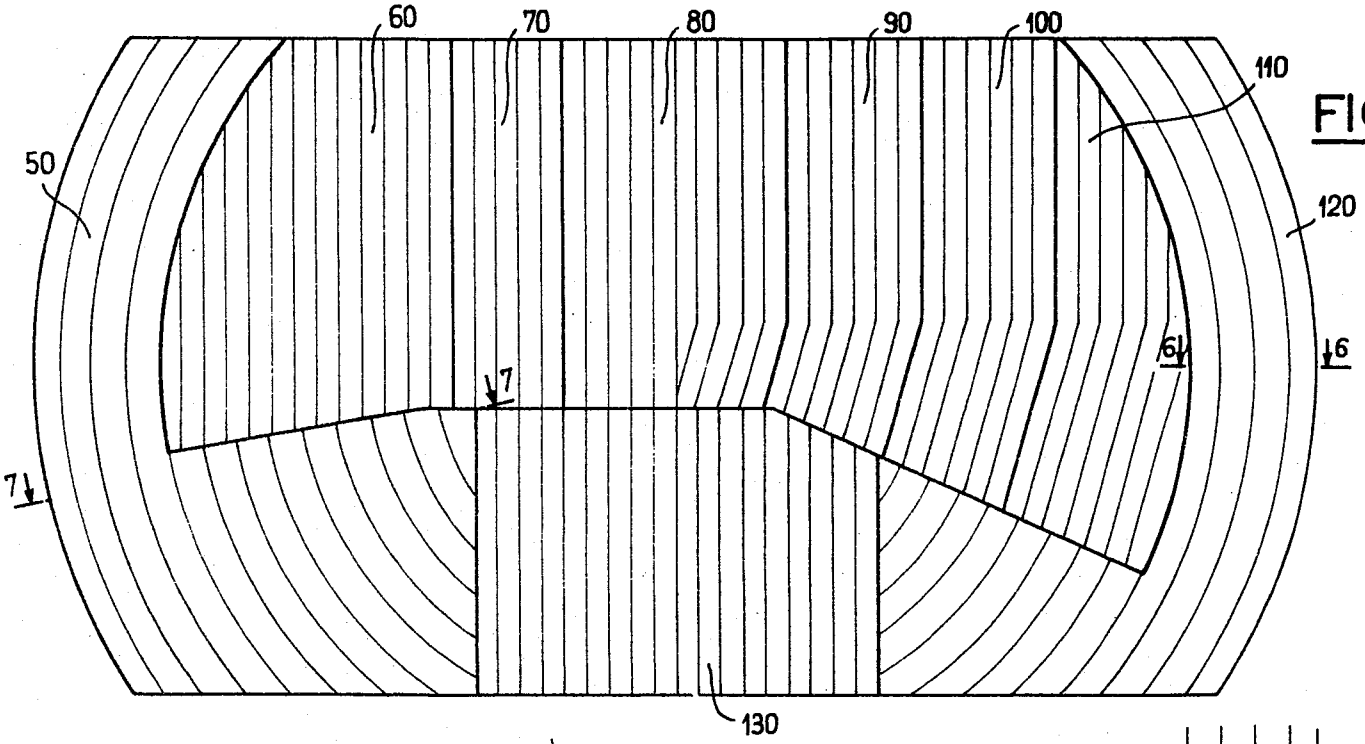
FIG. 5 shows a front view of an embodiment of the front glass for a headlight according to the invention.

FIG. 5 shows a preferred, but non-limiting embodiment of a front glass intended for a headlight according to the invention. The zones 60, 70, 80, 90, 100 and 110 constituted by grooves or prisms determined virtually solely as a function of the dipped-beam correspond to the zone 34 of the reflector. Similarly, zones 50, 120 and 130 determined to obtain a good far-beam correspond to zones 36 and 38 of the reflector.

Figure 6:
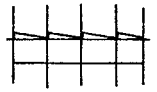
FIG. 6 shows a section along 6—6 of FIG. 5.
Figure 7:
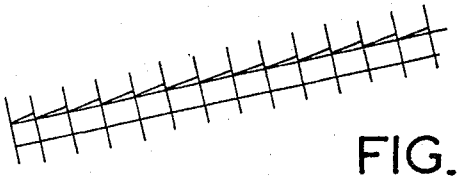
FIG. 7 shows a section along 7—7 of FIG. 5.

FIGS. 6 and 7, showing sections through zone 120 and through zone 50, demonstrate the use of deflecting prisms intended to concentrate the far-beam in order to obtain a considerable long-range light intensity.

It is obvious that the production of a sealed beam unit of this type is not limited to the above description; in particular, the size of the zone 36 of the reflector may be varied by modifying the dimensions and shape of the screen 20.

What is claimed is:

1. An automobile headlight of the type comprising a wide-opening parabolic reflector having an apex, a central optical axis and a focus;

a front glass overlying said reflector and opening and connected thereto, provided with grooves, prisms and outer contours;

and a twin-filament lamp for far-beam and dipped-beam located on said axis on opposite sides of said focus, the far-beam filament being located between said apex and the focus;

intercepting means within the reflector including a screen located on the front of and substantially above said axis and the upper part of the lamp, for defining on the periphery of the reflector zones which are stuck only by the rays emitted by the far-beam filament;

and the corresponding part of the front glass having concentrating grooves and prisms determined as a function of the far-beam only;

that part of the front glass corresponding to the zone defined by interception having an inner limit substantially parallel to the outer contours of the glass.

2. The headlight of claim 1, wherein the screen also acts as direct-light-screen.

3. The headlight of claim 1, (wherein, the case of the) said wide opening and glass being substantially rectangular in shape, the (joining means) connection between the reflector and the glass, (or the side, may be) being used as reflector for the far-beam only.

* * * * *